US006233835B1

(12) United States Patent
Brown et al.

(10) Patent No.: US 6,233,835 B1
(45) Date of Patent: May 22, 2001

(54) SCRIBE/GUIDE TOOL ADAPTED FOR STAIR CONSTRUCTION

(76) Inventors: Jacob Eugene Brown, P.O. Box 10372, Salinas, CA (US) 93912; Henry W. Cooper, 825 Brown Rd., San Juan Batista, CA (US) 95045

( * ) Notice: Subject to any disclaimer, the term of this patent is extended or adjusted under 35 U.S.C. 154(b) by 0 days.

(21) Appl. No.: 09/334,713

(22) Filed: Jun. 16, 1999

(51) Int. Cl.[7] ..... B43L 7/00; B43L 9/02

(52) U.S. Cl. ..... 33/27.02; 33/27.03; 33/41.1; 33/29; 33/474; 33/484

(58) Field of Search ..... 33/1 G, 27.01, 33/27.02, 27.03, 27.031, 27.032, 41.1, 41.6, 42, 29, 474, 475, 429, 483, 484, 485, 492, 18.1, 32.1, 32.2, 34, 666, 677, 678, 574, 579

(56) References Cited

U.S. PATENT DOCUMENTS 175,113 * 3/1876 Kuhns ..... 33/474
939,597 * 11/1909 Hurst ..... 33/27.031
2,621,409 * 12/1952 Dvorak ..... 33/27.03
2,621,412 * 12/1952 Slusher, Jr. ..... 33/27.03
2,805,484 * 9/1957 D'Aoust ..... 33/485
3,025,602 * 3/1962 Iovinelli ..... 33/32.2
3,623,232 * 11/1971 Mahlstadt ..... 33/474
4,393,600 * 7/1983 Coe ..... 33/474

* cited by examiner

*Primary Examiner*—Diego Gutierrez
*Assistant Examiner*—Lydia M. De Jesús
(74) *Attorney, Agent, or Firm*—The Kline Law Firm

(57) ABSTRACT

A scribe/guide tool used as a compass and to layout stair stringers. The tool is also used in conjunction with a straightedge or a rule to function as a compass, and is most often used in pairs. A scribe means is removably inserted into the body of the tool. The tool includes a clamping means with smooth surfaces to affix the scribe/guide tool to another cooperating tool. A clamp element is moved up and down relative to the main body via a screw drive. Position indicating edges of the main body of the tool are tapered to a very narrow point to reduce the possibility of accumulated error when marking a workpiece with the tool as a guide.

14 Claims, 3 Drawing Sheets

SCRIBE/GUIDE TOOL ADAPTED FOR STAIR CONSTRUCTION

FIELD OF THE INVENTION

The present invention relates generally to construction tools, and more particularly is a scribe/guide tool used as a compass or for the layout of stair stringers.

BACKGROUND OF THE INVENTION

In construction, it is often necessary to perform measuring operations that require tools that serve as a compass. One such task is squaring floors and walls. Typically, the builder will use a pencil in conjunction with his tape or a string line to make these measurements. The width of the tape makes it very difficult to achieve an accurate measurement using the tape as a compass. Using the string line provides a more accurate measurement, but is very time consuming.

Another very time-consuming task in construction is laying out a stair stringer (or carriage) for a set of stairs. Every set of stairs is defined by the rise and run in which it will be installed. The rise is the vertical distance that the stairs will cover, and the run is the horizontal length occupied by the stairs. The first hurdle that must be overcome is determining the respective lengths for the risers and treads of the stairs. Defined in terms of each other, the length of the riser is the vertical distance between the individual treads, and the length of the tread is the horizontal distance between the individual risers. To determine these lengths, the builder considers local building codes in conjunction with the end user's desires, and is then able to calculate the proper lengths of risers and treads.

When the calculation problem has been solved, the next step is to physically lay out the stair stringer on the lumber workpiece. This task is made somewhat difficult because of the necessity of repeated orthogonal measurements that must be made to mark the correct boundaries of the risers and the treads. The current art method requires the builder to use a triangulation method in which one leg of a right triangle (defined by a framing square) is the riser, the second leg of the triangle is the tread, and the hypotenuse is situated at the edge of the workpiece.

After marking the position of the riser and the tread, the builder needs to mark on the edge of the workpiece the end point of one step to start the layout of the next step. This leads to a source of error due to the fact that the edge of the workpiece can never be completely square. The mill run construction grade lumber typically used for stringers has a significant radius of curvature. This radius means that the hypotenuse of the triangle used to lay out the steps, instead of being on the surface of the board, is in actuality located in open space. The builder will therefore mark the end point of the step by sighting along a line that is perpendicular to the square, and that passes through the end of the hypotenuse. Because the builder has to make this sight at nearly an arm's length, the marking and repositioning of the framing square is subject to significant accumulated error. Moreover, the builder may grow weary of continually repositioning himself to have a the best available sight line to the end of the square.

Accordingly, it is an object of the present invention to provide a tool that functions as an accurate compass.

It is another object of the present invention to provide a method to reduce the accumulated error created by the repeated positioning of a framing square in stair stringer layouts.

It is a further object of the present invention to provide a tool that allows the user to reduce the amount of time required to mark out a stringer.

It is a still further object of the present invention to provide a tool that can be used for other marking operations as weli, specifically operations that ordinarily require a compass.

SUMMARY OF THE INVENTION

The present invention is a scribe/guide tool that is used as a scribe tool in conjunction with a straightedge or a rule to function as a compass to aid in the layout of stair stringers. The tool is most often used in pairs. A scribe means is removably inserted into the body of the tool.

The tool comprises a clamping means with smooth surfaces to affix the scribe/guide tool to another measuring tool. In the preferred embodiment, the scribe/guide tool comprises a main body with a clamp element secured therein. The clamp element is moved up and down relative to the main body via a screw drive. The scribe means is secured in the screw drive by a retaining ring. The position indicating edges of the main body of the tool are tapered to a very narrow point to reduce the possibility of accumulated error when marking a workpiece with the tool as a guide.

An advantage of the present invention is that it may be used to accurately mark repeated equally spaced distances on a workpiece.

Another advantage of the present invention is that it reduces the possibility of accumulated error when marking a rounded edge of a workpiece.

A still further advantage of the present invention is that it greatly simplifies the layout procedure for stair stringers.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1B:
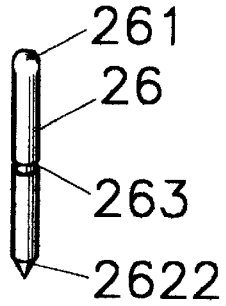
FIG. 1*b* shows a scribe means with a more blunt pointed end.
Figure 1A:
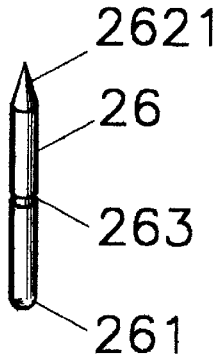
FIG. 1*a* shows a scribe means with a sharp pointed end.
Figure 2:
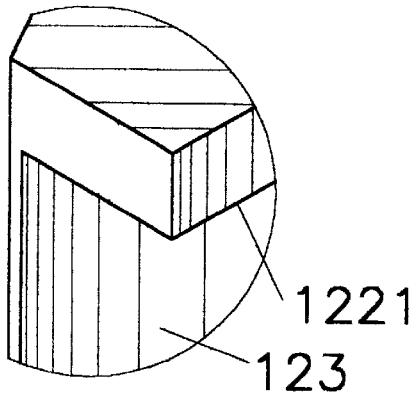
FIG. 2 is an isometric enlarged view of that area circled and labeled "2" in FIG. 1.
Figure 1:
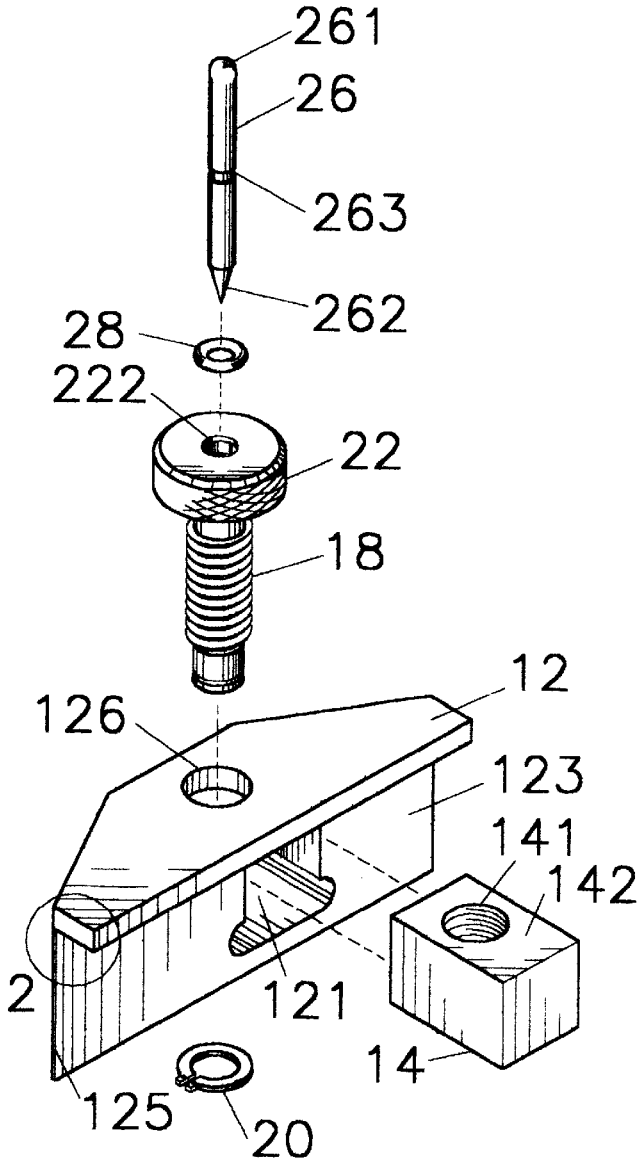
FIG. 1 is an exploded isometric view of the scribe/guide of the present invention.
Figure 3:
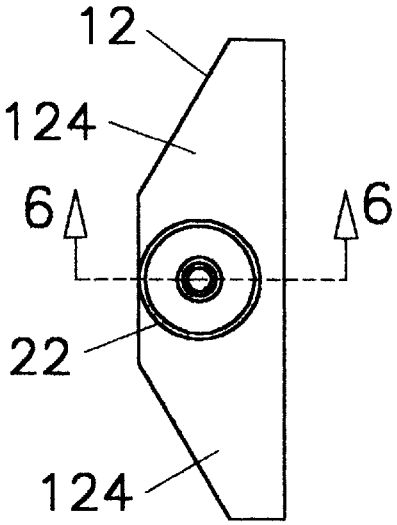
FIG. 3 is an orthographic top view of the scribe/guide.
Figure 4:
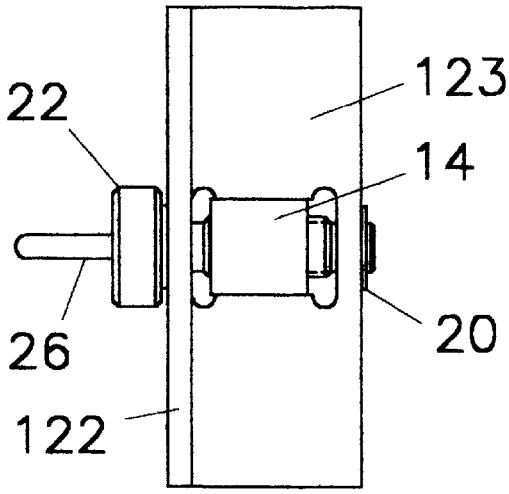
FIG. 4 is an orthographic side view of the scribe/guide
Figure 5:
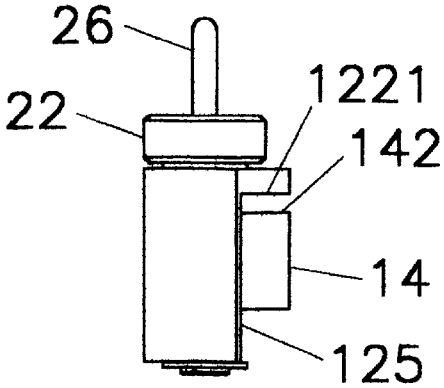
FIG. 5 is an orthographic end view of the scribe/guide.
Figure 6:
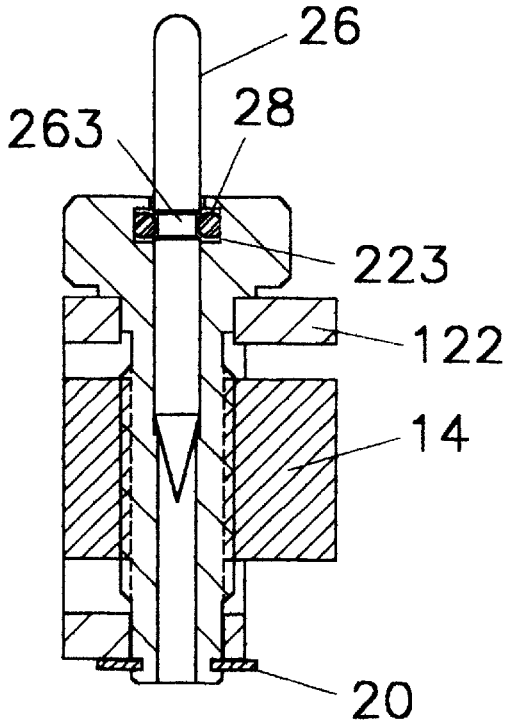
FIG. 6 is an orthographic sectional view along line 6—6 in FIG. 3.

The present invention is a scribe/guide tool 10 adapted to be affixed to a cooperating measuring tool. Referring first chiefly to FIGS. 1–6, the scribe/guide tool 10 comprises a main body 12. The main body 12 includes a central opening 121 that receives a clamp element 14. The main body 12 further includes a projection 122. The projection 122 projects outward from the main body 12 and is perpendicular to an adjacent front surface 123. The projection 122 and the front surface 123 are adapted to fit over an edge 161 of a workpiece 16.

A rear surface of the main body includes two tapered ends 124. The ends 124 are tapered to sharp position indicating edges 125 so that the thickness of the position indicating edges 125 is negligible for most purposes. The edges 125 serve as marking guides in many operations. If the thickness of the edges 125 is a consideration in any given application, the position of the scribe/guide tool 10 on the cooperating tool can be adjusted to compensate for the thickness of the edges 125.

The clamp element 14 is secured in the central opening 121 of the main body 12 by a screw drive 18. The screw drive 18 passes through a threaded through hole 141 aligned with non-threaded through ways 126 in the main body 12. The screw drive 18 is secured in position in the main body 12 at a lower end by a snap ring 20 and at an upper end by a bushing 221 of a thumb wheel 22. The bushing 221 will typically be integral to the thumb wheel 22.

A lower surface 1221 of the projection 122 and an upper surface 142 of the clamp element 14 are smooth, and cooperate to form an affixing mechanism. Because the surfaces 1221, 142 that form the affixing means are smooth, the tool 10 can be affixed to relatively fragile cooperating tools, such as a flexible steel tape or a fabric surveyor's tape. To accomplish the attachment, the thumb wheel 22 is turned by a user to rotate the screw drive 18. The rotation of the thumb wheel 22 drives the clamp element 14 up and down on the screw drive so that the scribe/guide tool 10 is affixed to and released from (depending on the direction of rotation of the thumb wheel 22) a desired cooperating tool.

A scribe means 26 is secured in a receiving hole 222 in the thumb wheel 22 that extends into the screw drive 18. The scribe means 26 has a rounded end 261 and a pointed end 262. The pointed end 262 can have a sharp point 2621 to be used on relatively soft surfaces such as wood, or a blunt point 2622 to be used on harder surfaces such as metals. The scribe means 26 is secured in the receiving hole 222 by a retaining ring 28 secured in an axial groove 223 in the thumb wheel 22. The retaining ring 28 is typically a rubber O-ring. The scribe means 26 can be inserted into the receiving hole 222 with the pointed end 262 protruding for scribing purposes, or the scribe means 26 can be inserted with the rounded end 261 protruding to prevent damage to, or by, the pointed end 262.

The scribe/guide tool 10 can be used individually, but will more generally be used in pairs. While the uses of the tool are myriad, two specific examples are given below.

EXAMPLE 1

As a compass: For this use, the scribe/guide tool 10 would most often be used with the scribe means 26 mounted so that the pointed end 262 is exposed. While it is possible to just use one scribe/guide tool 10, for greater efficiency, a pair of the scribe/guide tools 10 is clamped to a scale. The pointed end 262 of one scribe/guide tool 10 is used as a center, and the pointed end 262 of the second scribe/guide tool 10 is used to define the radius of the arc. The scribe means 26 is located midway between the two parallel position indicating edges 125. Hence, one may use either the left position indicating edge 125 of each scribe/guide tool 10 in the pair, or one may use the right position indicating edge of each tool 10 to indicate position. In either case the pointed ends 262 of the scribe means 26 will be spaced the same distance apart as the indicating edges 125.

EXAMPLE 2

Figure 7:
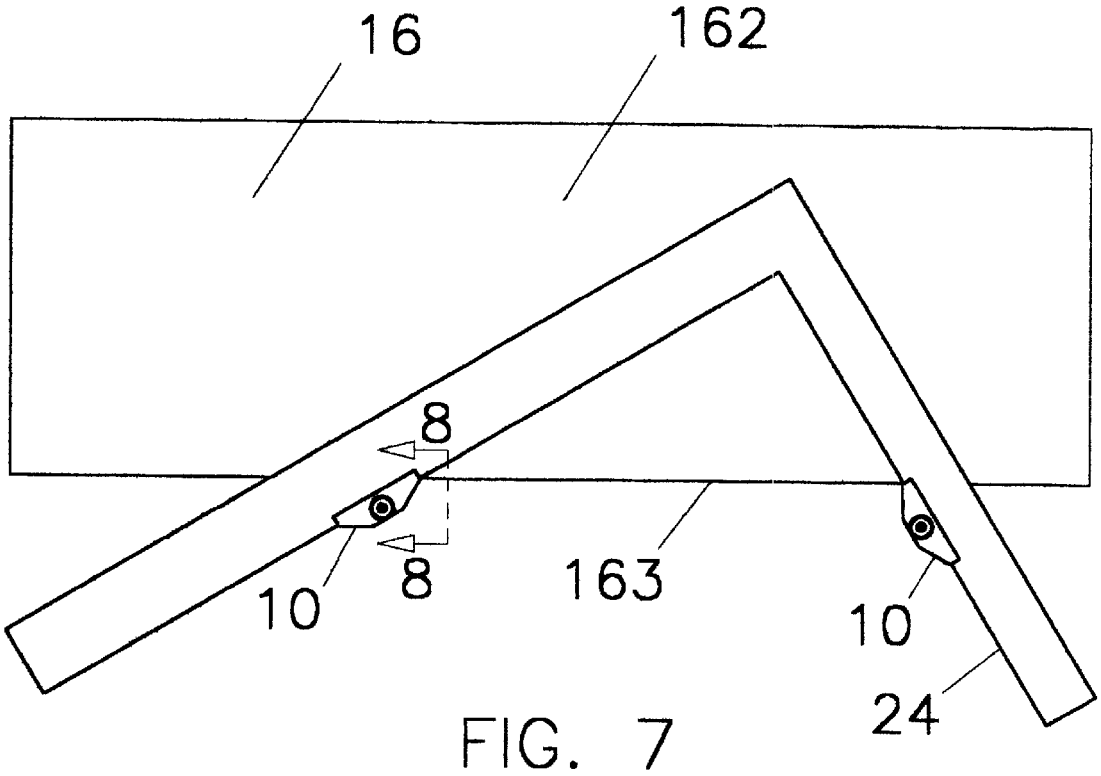
FIG. 7 is an orthographic top view of the tool of the present invention showing the scribe/guide in use on a workpiece.
Figure 8:
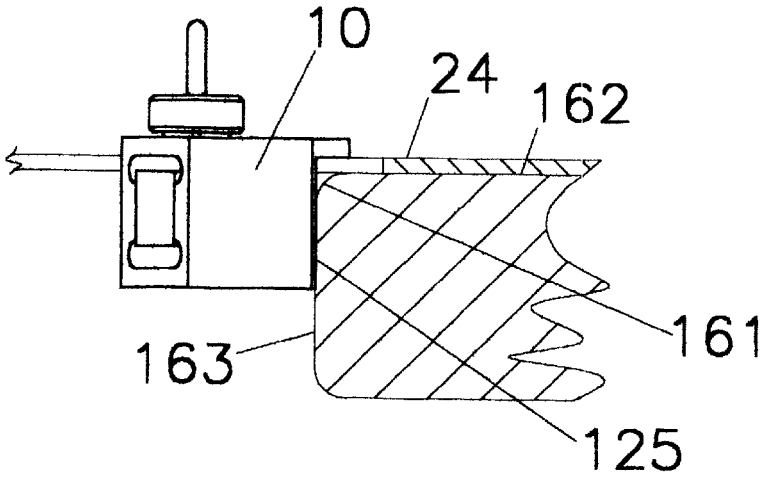
FIG. 8 is an orthographic partial sectional view along line 8—8 in FIG. 7.

Stair stringer layout: The current art procedure for laying out a stair stringer was described above in the description of the prior art. Referring now to FIGS. 7 and 8, with the scribe/guide tool 10 of the present invention, the rounded edge 161 of the workpiece 16 no longer creates a problem. The reference triangle is still formed with the two arms of the framing square 24 defining the two legs of the right triangle. A first scribe/guide tool 10 is positioned on one arm so that an inner indicator edge 125 is at a distance (measured from the arm intersection of the square) that is equal to the "rise". The second scribe/guide tool 10 is positioned similarly on the second arm of the framing square 24. but with the inner indicating edge 125 at a distance equal to the "run". The end of the hypotenuse of the reference triangle must still be marked, however, when using the scribe/guide tool 10, the hypotenuse no longer lies in unbounded space.

The inner position indicating edges 125 of the scribe/guide tool 10 is now perpendicular to, and marks the ends of, the hypotenuse of the reference triangle. The user can therefore easily and accurately mark the end point of each step of the stringer on the side surface 163 of the workpiece 16. In this manner, very little error will accumulate during the layout process.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A scribe/guide tool used with a cooperating measuring tool comprising:

a main body and a clamping mechanism, said main body further includes a projection that projects outward from said main body perpendicular to an adjacent front surface of said main body, such that said projection and said front surface form a means to receive an edge of a workpiece, and a rear surface of said main body includes two tapered ends tapered to sharp position indicating edges so that a thickness of said position indicating edges is negligible for most measuring purposes, said position indicating edges serving as marking guides, and said clamping mechanism affixes said scribe/guide tool to the cooperating measuring tool; wherein a clamp element is secured in a central opening of said main body by a screw drive, said screw drive is received in a threaded through hole in said clamp element, said threaded thorough hole in said clamp element is aligned with non-threaded through ways in said main body that receive non-threaded ends of said screw drive so that said screw drive is rotatable secured in said main body, and said screw drive includes a rotating means; such that operation of said rotating means of said screw drive causes said screw drive to rotate driving said clamp element up and down on said screw drive which reduces and increases respectively a distance between said clamp element and said projection so that a clamping area is formed therebetween, enabling said scribe/guide tool to be affixed to and released from the cooperating tool.

2. The scribe/guide tool as defined in claim 1 wherein:

surfaces of said clamping mechanism are smooth, thereby ensuring that a clamping area is smooth so that said scribe/guide tool causes no damage and is not damaged when affixed to cooperating tools.

3. The scribe/guide tool as defined in claim 1 wherein:

a lower surface of said projection and an upper surface of said clamp element are smooth, thereby ensuring that said clamping area is smooth so that said scribe/guide tool causes no damage and is not damaged when affixed to cooperating tools.

4. The scribe/guide tool as defined in claim 1 wherein:

a scribe means is received in a receiving hole in said scribe/guide tool.

5. The scribe/guide tool as defined in claim 4 wherein:

said scribe means is reversibly received in said receiving hole and releasably held therein by a securing means, and wherein opposing ends of said scribe means have different profiles.

6. The scribe/guide tool as defined in claim 5 wherein:

a first end of said scribe means has a rounded profile, and a second end of said scribe means has a pointed profile.

7. The scribe/guide tool as defined in claim 1 wherein:

a scribe means is received in a receiving hole in said scribe/guide tool.

8. The scribe/guide tool as defined in claim 7 wherein:

said scribe means is reversibly received in said receiving hole, and opposing ends of said scribe means have different profiles.

9. The scribe/guide tool as defined in claim 8 wherein:

a first end of said scribe means has a rounded profile, and a second end of said scribe means has a pointed profile.

10. A scribe/guide tool used with a cooperating measuring tool comprising:

a main body and a clamping mechanism, said main body includes a projection that projects outward from said main body perpendicular to an adjacent front surface of said main body, such that said projection and said front surface form a means to receive an edge of a workpiece, and a rear surface of said main body includes two tapered ends tapered to sharp position indicating edges so that a thickness of said position indicating edges is negligible for most measuring purposes, said position indicating edges serving as marking guides, and a scribe means is received in a receiving hole in said scribe/guide tool; and said clamping mechanism affixes said scribe/guide tool to the cooperating measuring tool; wherein a clamp element of said clamping mechanism is secured in a central opening of said main body by a screw drive, said screw drive is received in a threaded through hole in said clamp element, said threaded thorough hole in said clamp element is aligned with non-threaded through ways in said main body that receive non-threaded ends of said screw drive so that said screw drive is rotatably secured in said main body, and said screw drive includes a rotating means; such that operation of said rotating means of said screw drive causes said screw drive to rotate, thereby driving said clamping element up and down on said screw drive which reduces and increases respectively a distance between said clamp element and said projection so that a clamping area is formed therebetween, thereby enabling said scribe/guide tool to be affixed to and released from the cooperating tool.

11. The scribe/guide tool as defined in claim 10 wherein:

surfaces of said clamping mechanism are smooth, thereby ensuring that a clamping area is smooth so that said scribe/guide tool causes no damage and is not damaged when affixed to cooperating tools.

12. The scribe/guide tool as defined in claim 10 wherein:

a lower surface of said projection and an upper surface of said clamp element are smooth, thereby ensuring that said clamping area is smooth so that said scribe/guide tool causes no damage and is not damaged when affixed to cooperating tools.

13. The scribe/guide tool as defined in claim 10 wherein:

said scribe means is reversibly received in said receiving hole and releasably held therein by a securing means, and wherein opposing ends of said scribe means have different profiles.

14. The scribe/guide tool as defined in claim 13 wherein:

a first end of said scribe means has a rounded profile, and a second end of said scribe means has a pointed profile.

* * * * *